US011332267B2

(12) United States Patent
Bischoff et al.

(10) Patent No.: US 11,332,267 B2
(45) Date of Patent: May 17, 2022

(54) FILLING DEVICE, IN PARTICULAR FOOD PRODUCT FILLING DEVICE, FOR A METERING OF A GIVEN WEIGHT AND/OR VOLUME OF A FILLING MATERIAL THAT IS TO BE METERED, SYSTEM WITH THE DEVICE, AND METHOD

(71) Applicant: Ampack GmbH, Königsbrunn (DE)

(72) Inventors: Bernd Konrad Bischoff, Waiblingen (DE); Detlef Mueller, Schwäbisch Hall (DE); Wolfgang Schmitt, Schorndorf (DE)

(73) Assignee: Ampack GmbH, Königsbrunn (DE)

( * ) Notice: Subject to any disclaimer, the term of this patent is extended or adjusted under 35 U.S.C. 154(b) by 0 days.

(21) Appl. No.: 17/313,195

(22) Filed: May 6, 2021

(65) Prior Publication Data

US 2021/0354860 A1 Nov. 18, 2021

(30) Foreign Application Priority Data

May 15, 2020 (DE) ..... 10 2020 113 314.6

(51) Int. Cl.
*B65B 1/32* (2006.01)
*B65B 1/36* (2006.01)

(52) U.S. Cl.
CPC ..... *B65B 1/366* (2013.01); *B65B 1/32* (2013.01)

(58) Field of Classification Search
CPC .... B65B 1/30; B65B 1/32; B65B 1/36; B65B 1/366
See application file for complete search history.

(56) References Cited

U.S. PATENT DOCUMENTS 936,169 A 10/1909 Rulison
3,346,144 A * 10/1967 Hings ..... B01F 15/0218 222/57
3,418,140 A * 12/1968 Fisher ..... B65B 9/042 426/394
3,476,037 A * 11/1969 Gorbyjack ..... B65B 1/24 100/223

(Continued)

FOREIGN PATENT DOCUMENTS

CN 208198887 U 12/2018
DE 102017204083 A1 9/2018
GB 596300 A 1/1948

OTHER PUBLICATIONS

German Patent Office Examination Report for Application No. 102020113314.6 dated Dec. 17, 2020 (8 pages including English translation).

(Continued)

*Primary Examiner* — Nicolas A Arnett
(74) *Attorney, Agent, or Firm* — Michael Best & Friedrich LLP

(57) ABSTRACT

A filling device for a metering of a given weight and/or volume of a filling material (14) that is to be metered, including a collecting container (20) which is configured for the filling material (14) that is to be metered to be collected therein, and further including a metering element which is configured, for a metering of the filling material (14), to remove a defined volume of the filling material (14) out of the collecting container (20), and including a support module (26) movably supporting the metering element (24, 28).

13 Claims, 6 Drawing Sheets

(56) References Cited

U.S. PATENT DOCUMENTS 3,620,415 A * 11/1971 Ruth ..... C02F 1/686 222/57
4,437,294 A * 3/1984 Romagnoli ..... B65B 1/366 53/553
4,469,148 A * 9/1984 Vogele ..... B65B 39/002 141/87
4,650,098 A * 3/1987 Ellis ..... G01F 13/00 222/252
4,889,263 A * 12/1989 Ellis ..... A47F 1/03 222/185.1
5,377,727 A * 1/1995 Ueda ..... B65B 1/366 141/178
5,826,633 A * 10/1998 Parks ..... B65B 9/042 141/18
6,431,407 B1 * 8/2002 Hogan ..... B65B 1/366 141/236
6,805,174 B2 * 10/2004 Smith ..... B65B 1/366 141/103
6,837,281 B2 * 1/2005 Spiers ..... B65B 1/366 141/125
7,392,636 B2 * 7/2008 Conti ..... B65B 9/023 53/433
7,661,248 B2 * 2/2010 Conti ..... B65B 29/025 53/529
7,849,889 B2 * 12/2010 Smith ..... B65B 1/366 141/125
7,849,891 B2 * 12/2010 Hashiba ..... B65B 37/20 141/249
10,399,712 B2 * 9/2019 Longest, Jr ..... B65B 29/00
2020/0115072 A1 4/2020 Runft et al.

OTHER PUBLICATIONS

European Patent Office Action for Application No. 21173223.5 dated Oct. 22, 2021 (6 pages including English translation).
European Patent Office Search Report for Application No. 21173223.5 dated Oct. 11, 2021 (7 pages including English translation).

* cited by examiner

FILLING DEVICE, IN PARTICULAR FOOD PRODUCT FILLING DEVICE, FOR A METERING OF A GIVEN WEIGHT AND/OR VOLUME OF A FILLING MATERIAL THAT IS TO BE METERED, SYSTEM WITH THE DEVICE, AND METHOD

BACKGROUND

A filling device, in particular food product filling device, for a metering of a given weight and/or volume of a filling material that is to be metered, has already been proposed.

SUMMARY

According to the invention, a filling device, in particular food product filling device, for a metering of a given weight and/or volume of a filling material that is to be metered, is proposed, with a collecting container which is configured for the filling material that is to be metered to be collected therein, with a metering element, which is in particular implemented as a metering ladle, and which is configured, for a metering of the filling material, to remove a defined volume of the filling material out of the collecting container, and with a support module movably supporting the metering element. By a "filling device" is preferably a device to be understood which is configured to fill a material, preferably a filling material, in a metered manner into at least one receptacle that is to be filled, preferably into a plurality of receptacles that are to be filled. Preferentially the filling device is configured for simultaneously filling a plurality of receptacles with a defined weight and/or volume of a filling material. By a "food product filling device" is preferably a filling device to be understood which is configured for filling, in a metered manner, a filling material that is implemented as a food product into receptacles which are to be filled. By a "filling material that is to be metered" is preferably a bulk material to be understood, which preferably means a powdery, granular and/or particulate mixture present in a pourable form. Preferentially the filling material that is to be metered may have a moisture content. By a "collecting container" is preferably a container to be understood in which it is easily possible to catch, preferably collect, the filling material that is to be metered. Preferentially the filling material is arranged, i.e. collected, in the collecting container for a metered removal. The collecting container has a concave inner contour forming a receiving volume of the collecting container, in which the filling material is arranged for a metered removal. By a "metering element" is preferably an element to be understood which spans a metering volume, said metering volume being configured to be filled with the filling material for a metering of a filling material. The metering element preferably comprises a convex metering region which delimits the metering volume. The convex metering region is realized as a recess. Preferably the metering element is implemented as a metering ladle. By a "metering ladle" is preferably an element to be understood which has a connecting bar and a ladle bowl that is arranged on an end of the connecting bar and preferably forms the convex metering region. By a "support module" is preferentially a module to be understood which is configured for movably supporting at least one element, preferably the metering element. The support module is preferably configured to support an element that is to be supported, like preferably the metering element, such that it is rotationally and/or linearly displaceable. In this way an especially simple metering of a filling material that is to be metered is achievable by means of the filling device.

It is further proposed that for a removal of the defined volume of the filling material out of the collecting container, the metering element is configured to be moved through a receiving volume of the collecting container by means of the support module. By a "receiving volume" is preferably a volume to be understood which is spanned by the collecting container, in particular by a concave inner contour of the collecting container. The receiving volume preferably defines a space in which the filling material can be collected. "To be moved through the receiving volume" is preferably to mean that at least a convex metering region of the metering element is guided through the collecting container in such a way that the filling material collected in the collecting container can be taken in by the metering region. Preferably the metering element is guided through the receiving volume of the collecting container in a linear and/or rotational movement. Preferably the convex metering region is guided through the receiving volume of the collecting container in a linear and/or rotational movement. Especially preferentially the metering element is moved through the receiving volume of the collecting container in a pivoting movement. Principally it is also conceivable that the metering element is guided through the receiving volume of the collecting container in a linear movement or in a combined linear and rotational movement. In this way a removal of the filling material out of the collecting container can be carried out particularly easily, and the filling device can be implemented in an especially simple manner.

Furthermore, it is proposed that the support module forms a rotation axis and is configured to rotate the metering element around the rotation axis for the purpose of removing the defined volume of the filling material out of the collecting container. This enables an especially advantageous support of the metering element by the support module for a removal of the filling material.

It is also proposed that the support module is configured to rotate the metering element around the rotation axis for a transfer of the removed filling material to a receptacle that is to be filled. In this way a transfer of the filling material from the metering element can be carried out in a particularly simple manner.

Beyond this it is proposed that the support module comprises at least one linear bearing, by means of which the metering element is adjustable between a removal position and a transfer position. A "linear bearing" is in particular to mean a bearing which comprises at least two bearing elements which are linearly displaceable relative to each other along a bearing axis. A first bearing element of the linear bearing is preferably embodied as a linear bearing rail. By a "linear bearing rail" is in particular a linear guiding element to be understood which is configured to form a bearing path, preferably a straight bearing axis, along which a further element is linearly displaceable on the linear bearing rail. A linear bearing rail is configured such that a guiding element is connected thereon in a form-fit and/or force-fit manner, wherein the guiding element has one degree of freedom relative to the linear bearing rail at least along a path, in particular along the bearing axis. A second bearing element of the linear bearing may preferably be implemented as a guiding element. The second bearing element is implemented correspondingly to the first bearing element and is configured to be supported movably relative to the first bearing element. The second bearing element is preferably supported movably relative to the first bearing element along the bearing path. The second bearing element is preferably embodied as a bearing carriage, which is supported movably relative to the first bearing element, which is embodied as a linear bearing rail. The second bearing element preferably comprises a base body and at least one guiding element that is connected with the base body and is configured to be connected with the first bearing element for a movable support of the second bearing element. A "removal position" is preferably to mean an axial positioning of the metering element on the linear bearing in which the metering element is axially positioned in such a way that it can be guided through the collecting container in order to remove the filling material out of the collecting container. A "transfer position" is preferably to mean an axial positioning of the metering element on the linear bearing in which the metering element is axially positioned such that it is enabled to move the received filling material to a receptacle that is to be filled by a defined movement, preferably a rotation. This allows an especially easy adjustment of the metering element between the removal position and the transfer position.

It is further proposed that the filling device comprises a wipe-off element, which is configured, prior to a transfer of the filling material, to reduce the filling material located in the metering element to the given volume. By a "wipe-off element" is preferably an element to be understood which is configured for wiping off, i. e. removing out of the metering element, excess filling material, i.e. filling material that is more than a maximum filling amount, and to return said excess filling material to the collecting container. By means of the wipe-off element the filling material taken in by the metering element will always be reduced to a same, defined volume by traversing past the wipe-off element. In this way a precise and constant removal of a defined volume of filling material is especially advantageously achievable by means of the metering element.

Moreover, it is proposed that the support module is configured, in an adjustment from the removal position to the transfer position, to guide the metering element past the wipe-off element in order to wipe off and/or densify the filling material that is located in the metering element. By "guiding past the wipe-off element" is in particular to be understood that the metering element is guided along the wipe-off element at least with its metering region, wherein the wipe-off element preferably lies upon an upper edge of the metering region. Preferably the metering element is guided past the wipe-off element in such a way that the wipe-off element is arranged precisely at an upper end of the receiving volume, thus delimiting the metering volume. By "wipe off and/or densify" is in particular to be understood that the wipe-off element at least partly wipes off, i. e. removes from the metering element, a filling material protruding beyond the metering volume, i. e. beyond an upper edge of the metering region, and/or pushes a portion thereof into the metering volume of the metering region in order to thus densify the filling material that is located in the metering volume of the metering region. This enables a particularly simple and precise adjustment of the filling material located in the metering element to a desired volume and/or weight.

It is also proposed that the filling device comprises at least one transfer element, via which, in a transfer position of the metering element, the filling material that is to be metered can be conveyed from the metering element directly to a receptacle that is to be filled. By a "transfer element" is in particular an element to be understood through which or via which a filling material can be conveyed from a first end to a second end. The filling material is preferably moved through the transfer element by gravitation. The transfer element is preferably embodied as a tube element which the filling material can fall through. The transfer element is preferably embodied as a downpipe. The transfer element that is embodied as a transfer tube is preferably oriented vertically, such that a filling material entry and a filling material exit are arranged one above the other one. Principally it is also conceivable for the transfer element to be embodied as an inclined trough or as an inclined slide sheet, via which a filling material may slide from a first end to a second end. By a "receptacle that is to be filled" is preferably a receptacle to be understood which is configured for a secure storage and fresh-keeping of the filling material. A receptacle that is to be filled may, for example, be a plastic cup, a metal tin, a paper cup, or another receptacle that is configured for the storage of a filling material, in particular a food product, and is deemed expedient by someone skilled in the art. As a result, the metered filling material may be conveyed completely from the metering element to the receptacle that is to be filled in a particularly operationally safe manner. An implementation of the transfer element as a vertically-oriented down pipe permits the filling material to be conveyed to the receptacle that is to be filled in an especially advantageous manner.

Beyond this it is proposed that the collecting container is implemented as a tub, whose inner contour has an even curvature at least in a subregion. By the inner contour "having an even curvature at least in a subregion" is preferably to be understood that at least 50%, preferably 75% and in an especially advantageous implementation more than 90% of the inner contour have an even contour. Particularly preferentially the inner contour of the collecting container implemented as a tub forms a semicircular shape. Principally it is also conceivable that only a middle subregion of the inner contour of the collecting container implemented as a tub has an even curvature and outer regions form a smaller curvature or a straight line. This enables an especially advantageous implementation of the collecting container for a removal of the filling material by means of the metering element.

It is further proposed that the filling device comprises an outflow device, which is configured to transport away a liquid out of the collecting container, wherein an outlet opening is arranged below a minimum ladling level of the metering element. By an "outflow device" is preferably a device to be understood through which a liquid can flow out of the collecting container due to gravitation or can be sucked out of the collecting container actively. A "minimum ladling level" is preferably to mean a minimum level in the collecting container up to which the metering element may maximally extend with its metering region. "Below the minimum ladling level" is preferably to mean nearer to a ground, i. e. to a plane which the filling device is positioned on. In this way liquid is advantageously removable out of the collecting container, such that a gluing of the metering element and/or of other components of the filling device by liquid that may, for example, leak from the filling material is avoidable. As a result, it is in particular possible to improve cleanliness and precision of the filling device.

It is moreover proposed that the filling device comprises at least one further metering element, which is supported movably parallel to the one metering element via the support module and is configured, for a metering of the filling material, to remove a defined volume of the filling material out of the collecting container. By a "further metering element" is preferably a metering element to be understood which is implemented identically and is connected via the same support module as the first metering element and is preferably implemented exactly identically to the first metering element. It is principally also conceivable that a further metering element forms a larger metering volume, as a result of which differently-sized receptacles could be filled side by side by means of the filling device. This enables an especially advantageous implementation of the filling device for a filling into several receptacles.

It is also proposed that the filling device comprises at least one liquid-metering module which is configured, after a filling of a receptacle that is to be filled with a filling material by means of the metering element, to fill the receptacle with a liquid until a desired total filling volume and/or total filling weight has been reached. By a "liquid metering module" is preferably a module to be understood that is capable of adding a liquid to the metered filling material into the receptacle that is to be filled. Preferably a liquid is injected into the receptacle. Preferably the liquid metering module is arranged spaced apart, i. e. spatially separate, from the metering elements and the collecting container. This advantageously allows dividing the filling device into a dry region, namely the metering by means of the metering elements, and a wet region, namely the filling of a liquid by means of the liquid metering module. In this way a total weight of the filling material arranged in the receptacle and the liquid can be adjusted in an especially favorable manner. Moreover, by a separation of the metering of the dry filling material and the filling of the liquid, an advantageous separation of a dry region and a wet region of the filling device is achievable, thus enabling an arrangement of liquid-sensitive components, for example weighing cells, advantageously outside the liquid region.

Furthermore, a system is proposed, with at least one filling device for filling receptacles that are to be filled with a given weight and/or volume of a filling material that is to be metered. Preferably the system comprises a control and/or regulation unit which is configured for a controlling of the filling device. A "control and/or regulation unit" is in particular to mean a unit with at least one control electronics component. A "control electronics component" is in particular to mean a unit with a processor unit and with a memory unit and with an operation program that is stored in the memory unit. "Configured" is in particular to mean specifically programmed and/or specifically equipped. By an object, in particular the control and/or regulation unit, being configured for a certain function, in particular for an adaption of a transfer parameter, is in particular to be understood that the object fulfills and/or executes said certain function in at least one application state and/or operation state. By the implementation of the system according to the invention an advantageous metered filling of a filling material into a receptacle or a plurality of receptacles is achievable.

In addition, a method for a metering of a filling material by means of a filling device is proposed.

The device according to the invention, the system according to the invention and/or the method according to the invention are/is herein not to be limited to the application and implementation described above. In particular, for the purpose of fulfilling a functionality that is described here, the device according to the invention, the system according to the invention and/or the method according to the invention may comprise a number of individual elements, components, units and method steps that differs from a number that is mentioned here.

Furthermore, in regard to the value ranges given in the present disclosure, values within the limits mentioned shall also be considered to be disclosed and to be usable as applicable.

BRIEF DESCRIPTION OF THE DRAWINGS

Further advantages will become apparent from the following description of the drawings. In the drawings an exemplary embodiment of the invention is illustrated. The drawings, the description and the claims contain a plurality of features in combination. Someone skilled in the art will purposefully also consider the features separately and will find further expedient combinations.

It is shown in.

DETAILED DESCRIPTION

Figure 1:
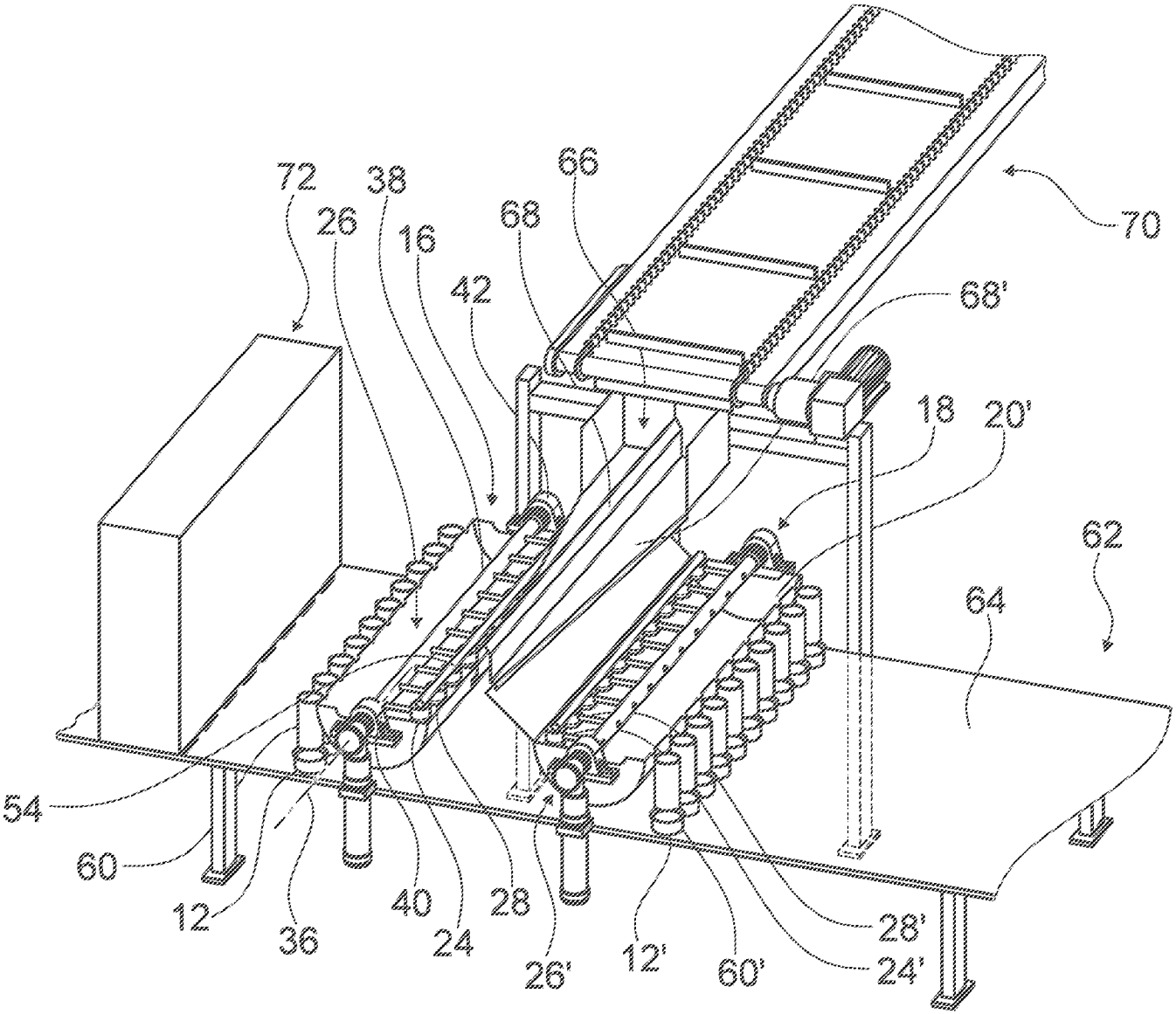
FIG. 1. a schematic view of a system with a filling device.
Figure 2:
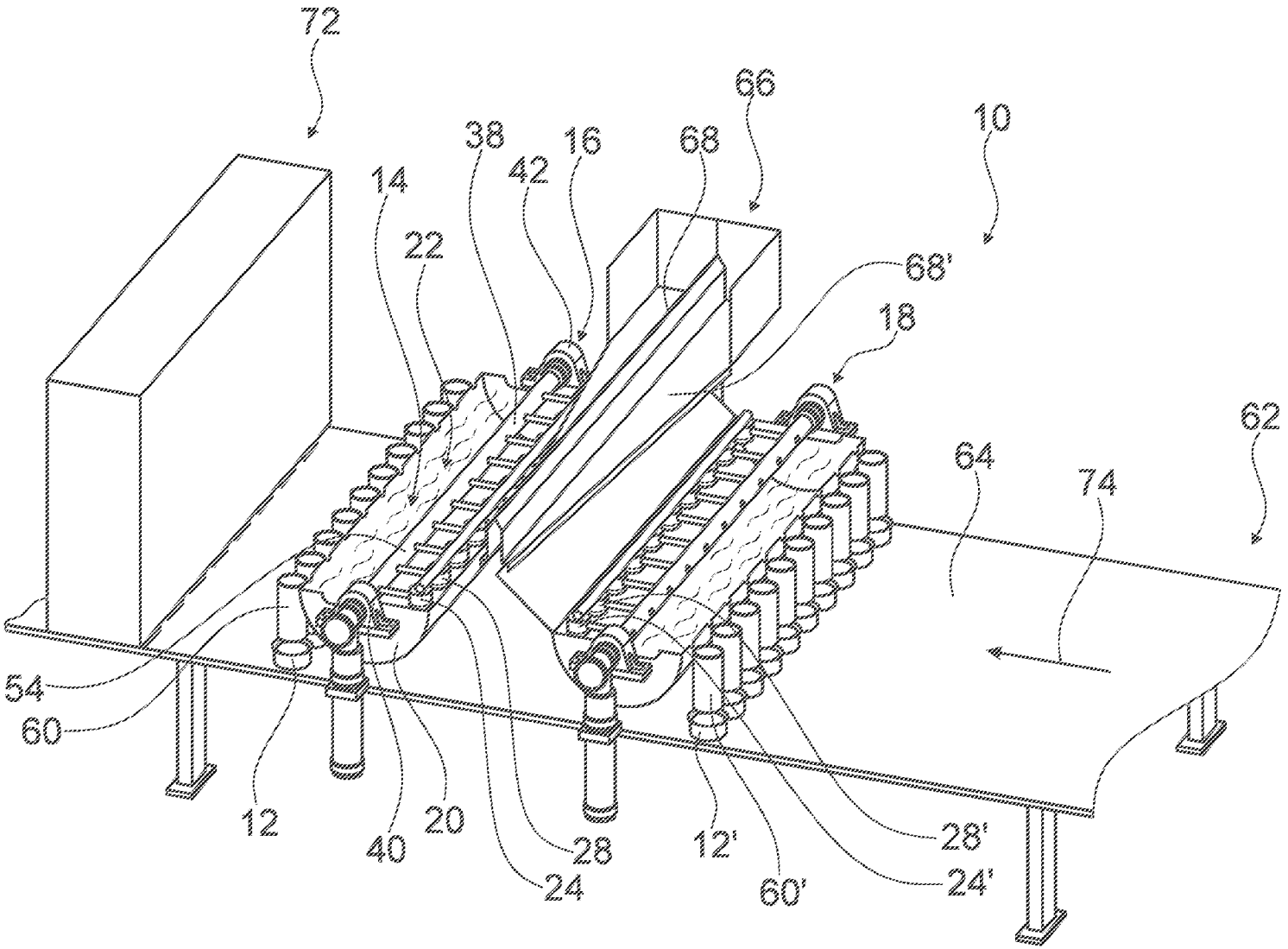
FIG. 2 a further view of the filling device with a conveying device.
Figure 3:
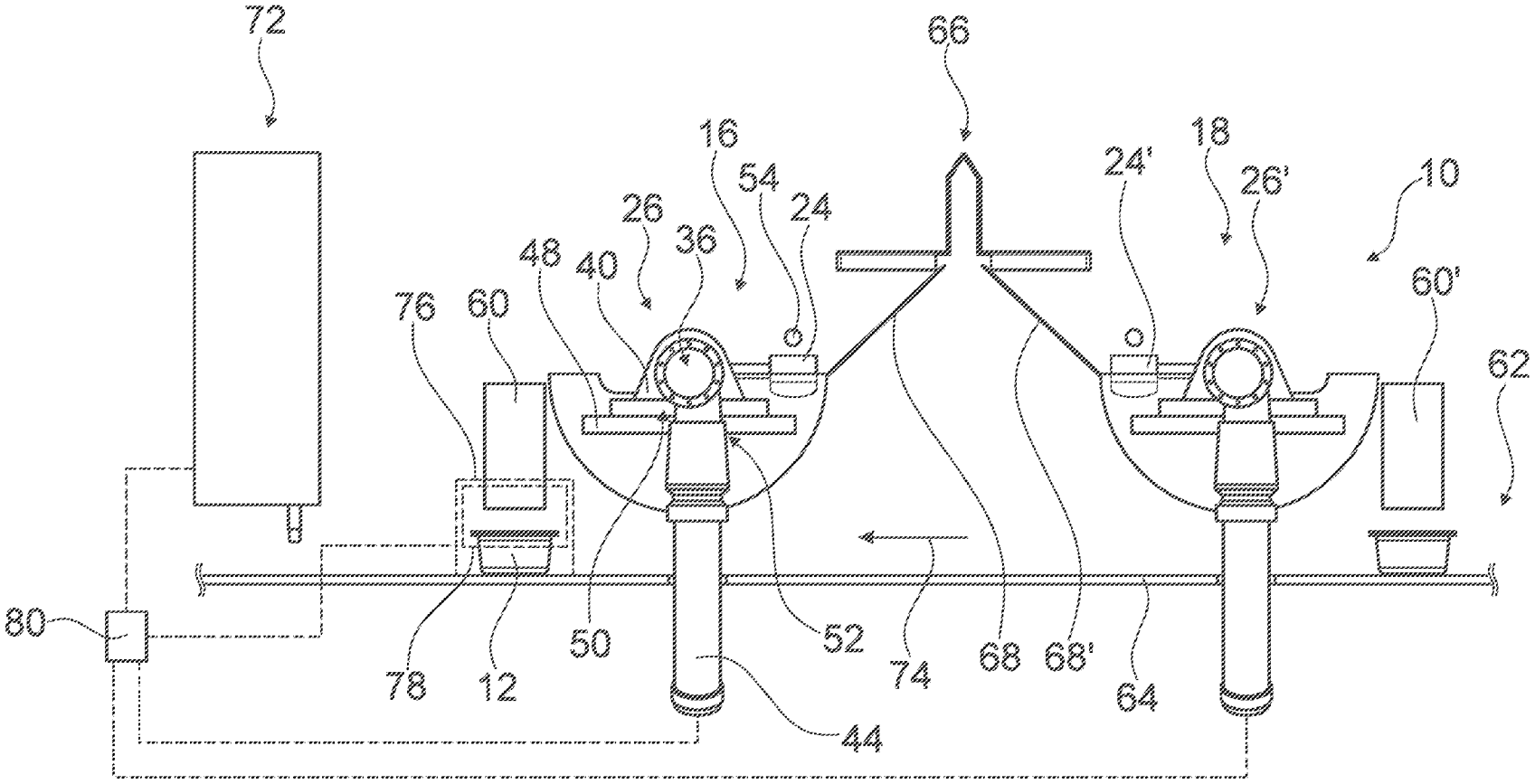
FIG. 3 a side view through the filling device with the conveying device and a liquid-metering module, FIG. 4 a detailed side view of a filling module of the filling device, with a metering element in a removal position, FIG. 5 a further detailed side view with the metering element during removal of filling material out of a collecting container, FIG. 6 a further detailed side view with the metering element after removal of the filling material, FIG. 7 a further detailed side view with the metering element after a linear traversing into a transfer position, and FIG. 8 a further detailed side view with the metering element after a rotation into a transfer position.

FIGS. 1 to 8 show a system according to the invention with a filling device 10. The system with the filling device 10 is configured for filling receptacles 12, 12' which are to be filled with a given weight and/or volume of a filling material 14 that is to be metered. The filling device 10 is implemented as a food product filling device. The filling device 10 is configured for a metered filling of a filling material 14 that is embodied as a food product. The filling device 10 is configured for a metering of a given weight and/or volume of the filling material 14 that is to be metered. The filling material 14 may for example be pieces of fruit. Preferably the filling material 14 is implemented by pieces of fruit which may have a moisture content. Principally it is also conceivable that the filling material 14 is implemented as a powder or as a different piece-wise bulk material. The system comprises a filling material feed. The filling material feed is here exemplarily realized as a conveyor belt. Principally it is also conceivable for the filling material feed to be realized in another way that is deemed expedient by someone skilled in the art.

The filling device 10 comprises two filling modules 16, 18. The two filling modules 16, 18 are implemented substantially identically, and therefore only the first filling module 16 will be described in detail in the following. For an explanation of the second filling module 18 the description of the first filling module 16 may be referred to. The two filling modules 16, 18 are connected in series one after the other one.

The filling module 16 of the filling device 10 comprises a collecting container 20. The collecting container 20 is embodied as a collecting tub. The collecting container 20 is embodied as a longish tub. The collecting container 20 comprises an inner contour having an even curvature. The collecting container 20 comprises a semi-circle-shaped inner contour. The collecting container 20 forms a receiving volume 22. The inner contour of the collecting container 20 delimits the receiving volume 22. The collecting container 20 is configured for the filling material 14 that is to be metered to be collected therein. The collecting container 20 is mounted via a mounting unit that is not shown in detail. The mounting unit could, for example, be realized as a frame standing on feet.

The filling module 16 of the filling device 10 comprises a metering element 24. The metering element 24 is configured, for the purpose of metering the filling material 14, to remove a defined volume of the filling material 14 out of the collecting container 20. The filling device 10 comprises a support module 26, which is configured for a support of the metering element 24. The metering element 24 is movably supported via the support module 26. The metering element 24 is supported via the support module 26 in such a way that it is movable relative to the collecting container 20. The filling module 16 of the filling device 10 comprises further metering elements 28. The metering elements 28 are arranged parallel to the metering element 24. The further metering elements 28 are also movably supported by the support module 26. For a metering of the filling material 14, the further metering elements 28 are configured to remove a defined volume of the filling material 14 out of the collecting container 20. By means of the further metering elements 28 and the metering element 24, respective simultaneous removal of a defined volume of the filling material 14 out of the collecting container 20 is enabled. In the implementation shown the first filling module 16 of the filling device 10 comprises ten metering elements 24, 28, which are movably supported by the support module 26 and are configured for a removal of a defined volume of the filling material 14 out of the collecting container 20. Principally it would also be conceivable that the first filling module 16 has a different number of metering elements 24, 28, for example four or twenty. The metering elements 24, 28 are implemented identically. Hence only the one metering element 24 will be described in detail in the following. For an explanation of all other metering elements 28 the following description of the one metering element 24 may be referred to.

The metering element 24 is realized as a metering ladle. The metering element 24 realized as a metering ladle has on a first end a convex metering region 30. The convex metering region 30 spans a metering volume 32. The convex metering region 30 has a cylinder-shaped inner contour. Principally it is also conceivable that the metering region 30 is realized as a hemisphere-shaped inner contour or that the inner contour has a different shape that is deemed expedient by someone skilled in the art. The metering volume 32 spanned by the convex metering region 30 of the metering element 24 corresponds to the volume to be metered of the filling material 14. The metering element 24 comprises a connecting bar 34. The metering region 30 is connected to a first end of the connecting bar 34. The metering region 30 may be implemented integrally with the connecting bar 34. Principally it is also conceivable that the metering region 30 is introduced in an element that is realized separately from the connecting bar 34 and is in a mounted state connected with the connecting bar 34. In this way differently-sized metering regions 30 could be connected with the connecting bar 34 in a particularly simple manner, and metering elements 24 having differently sized volumes could be provided easily for the metering of the filling material 14. On a second end the connecting bar 34 of the metering element 24 is connected with the support module 26. The metering element 24 is configured for a removal of a defined volume of the filling material 14 out of the collecting container 20. For a metered removal of the filling material 14 out of the collecting container 20, the metering element 24 is moved at least with its metering volume 32 through the receiving volume 22 of the collecting container 20.

The support module 26 forms a rotation axis 36. The support module 26 comprises a bearing shaft 38 that forms the rotation axis 36. The bearing shaft 38 is configured for a connection of the metering element 24, 28. The bearing shaft 38 extends in a transverse direction relative to the collecting container. The bearing shaft 38 extends in a mounted state parallel to a transverse axis of the collecting container 20. The bearing shaft 38 is supported rotatably around its middle axis, which is equivalent to the rotation axis 36. The support module comprises two bearing blocks 40, 42, which the bearing shaft 38 is supported on such that it is rotatable. The bearing blocks 40, 42 are respectively arranged on opposite-facing long sides of the collecting container 20. The bearing blocks 40, 42 each comprise a bearing receptacle, in which the bearing shaft 38 is rotatably supported. The two bearing blocks 40, 42 are arranged coaxially with each other with their bearing receptacles. The support module 26 comprises a first drive unit 44. The first drive unit 44 is embodied as an electromotor. Principally it would also be conceivable that the first drive unit 44 is embodied as a different drive unit, for example as a pneumatic or hydraulic motor. The drive unit 44 is configured for driving the bearing shaft 38. The drive unit 44 is consequently configured for moving the metering element 24. The first drive unit 44 is connected to the one bearing block 40.

The support module 26 comprises two linear bearings 46. The linear bearings 46 are configured to support respectively one bearing block 40, 42 relative to the collecting container 20. The linear bearings 46 each form a bearing axis, along which the bearing blocks 40, 42 are linearly displaceable. The bearing axes of the two linear bearings 46 run parallel to each other.

The linear bearings 46 each comprise a bearing rail 48. The bearing rail 48 is attached on an outer side of a side wall of the collecting container 20. Principally it is also conceivable that the support module 26 has its own frame, which the bearing rails 48 of the linear bearings 46 are arranged on in a positionally fixed manner, each next to the side wall of the collecting container 20. The linear bearings 46 each comprise a guiding element 50. The guiding elements 50 are respectively connected with the corresponding bearing rail 48 of the linear bearing 46 in a form-fit fashion. The guiding elements 50 are respectively coupled with the bearing rail 48 such that they are axially displaceable. The guiding elements 50 are axially displaceable relative to the bearing rails 48 along the bearing axis. Each of the guiding elements 50 is fixedly connected with a respective one of the bearing blocks 40, 42. Principally it is also conceivable that the guiding elements 50 are implemented integrally with the respective bearing block 40, 42. The support module 26 comprises a second drive unit 52, which is configured for an axial displacement of the guiding element 50 in the bearing rail 48. The second drive unit 52 is embodied as an electromotor. The support module 26 comprises a transmission unit (not shown in detail), which is configured to translate a rotational movement of the second drive unit 52 into an axial movement of the guiding element 50 relative to the bearing rail 48. The transmission unit could, for example, comprise a gear wheel that is connected with the guiding element 50, is rotationally drivable by means of the drive unit 52 and engages into a toothed rod which is coupled with the bearing rail 48.

The metering element 24 is connected to the bearing shaft 38. The metering element 24 is fixedly connected to the bearing shaft 38 with a second end that is situated opposite the metering region 30. Preferably the metering element 24 is connected to the bearing shaft 38 by a screw connection. Principally it is also conceivable that the metering element 24 is fixedly connected to the bearing shaft 38 by a form-fit connection and/or via substance-to-substance bond, for example by a welding or gluing connection. By means of the support module 26 the metering element 24 is axially displaceable along the bearing axis of the linear bearings 46 and supported rotatably around the rotation axis 36 of the bearing shaft 38 relative to the collecting container 20. All metering elements 24, 28 are connected to the bearing shaft 38. By means of the support module 26, all metering elements 24, 28 of the filling module 16 of the filling device are axially displaceable along the bearing axis of the linear bearings 46 and supported rotatably around the rotation axis 36 of the bearing shaft 38 relative to the collecting container 20. All metering elements 24, 28 of the filling module 16 of the filling device 10 are axially displaceable and rotatable simultaneously and in identical manners by the support module 26.

The filling module 16 of the filling device 10 comprises a wipe-off element 54. The wipe-off element 54 is configured, prior to a transfer of the filling material 14, to reduce the filling material 14 located in the metering element 24 to the given volume. The wipe-off element 54 is configured to wipe off filling material 14 protruding beyond the metering volume 32 of the metering element 24. The wipe-off element 54 is further configured to densify the filling material 14 that is located in the metering volume 32 of the metering element 24. By wiping off excess filling material 14 protruding from the metering volume 32, the filling material 14 taken in by the metering element 24 can be reduced to always respectively the same volume by means of the wipe-off element 54. By densifying the filling material 14 located in the metering region 30 of the metering element 24, an even filling of the metering region 30 with the filling material 14 is achievable. For wiping off and densifying the metering element 24 is guided along past the wipe-off element 54. Principally a movement of the wipe-off element 54 is also conceivable such that the wipe-off element 54 is traversed along the metering element 24. When the metering element 24 is traversed past the wipe-off element 54, preferably the filling material 14 located in the metering region 30 is preferably densified in the metering volume 32 and at the same time filling material 14 which cannot be pressed into the metering volume 32, and therefore protrudes beyond the metering volume 32, is wiped off. The wiped-off filling material 14 drops back into the collecting container 20. While the metering element 24 is guided past, the wipe-off element 54 preferably lies on an upper edge of the metering region 30. Principally it is also conceivable that a small gap remains between the metering element 24 and the wipe-off element 54. The wipe-off element 54 is embodied as a rod. The wipe-off element 54 that is embodied as a rod extends over an entire width of the collecting container 20. The wipe-off element 54 that is embodied as a rod extends over all the metering elements 24, 28 and is configured to wipe all the metering elements 24, 28. The wipe-off element 54 has a circular cross section. Principally it is also conceivable for the wipe-off element 54 to have a different cross section, for example a cross section having a flattened or tapering region on a side facing towards the metering element 24, 28. The wipe-off element 54 is preferably implemented of a stiff material. Principally it is preferably conceivable that the wipe-off element 54 has an elastic lip on the side facing towards the metering elements 24, 28, which densifies and wipes off the filling material 14.

The filling module 16 of the filling device 10 comprises one transfer element 60 per each metering element 24, 28. The transfer element 60 is configured to convey the filling material 14 that is to be metered from the corresponding metering element 24, 28 directly to the receptacle 12 that is to be filled. The transfer element 60 is realized as a transfer tube. The transfer element 60 realized as a transfer tube is arranged on a first axial end of the collecting container 20. The transfer element 60 is arranged in a transfer region of the corresponding metering element 24, 28. The transfer element 60 is preferably fixated to the collecting container 20. Principally it is also conceivable that the transfer elements 60 have their own frame, via which they are firmly fixated in the transfer region. The transfer element 60 realized as a transfer tube is oriented vertically. An upper end of the transfer element 60, which forms a filling material entry, is realized on a level with the upper edge of the collecting container 20. A lower end of the transfer element 60 is arranged below a lower end of the collecting container 20. The lower end of the transfer element 60 forms a filling material exit, out of which the filling material 14 can drop directly into a receptacle 12 that is to be filled. During filling the receptacle 12 that is to be filled preferably adjoins the filling material exit, allowing the metered filling material 14 to drop into the receptacle 12 completely.

The first filling module 16 of the filling device 10 comprises an outflow device 56. The outflow device 56 is configured such that a liquid collecting in the collecting container 20 can flow out of the collecting container 20. The outflow device 56 is configured such that a liquid collecting in the receiving volume 22 of the collecting container 20 can be transported away. The liquid may, for example, be a liquid leaked from the filling material 14 or a liquid which is part of the filling material 14 that is to be filled. The outflow device 56 is configured to convey away a liquid below the minimum ladling level of the metering elements 24, 28. The outflow device 56 comprises an outlet opening 58. The outlet opening 58 is introduced in a side wall of the collecting container 20 at a lower lateral edge of the collecting container 20. The outlet opening 58 is arranged below the minimum ladling level of the metering elements 24, 28. By putting the outlet opening 58 into a side wall of the connecting container 20, a clogging of the outlet opening 58 by filling material 14 is advantageously avoidable. Preferably the outflow device 56 comprises a drain permitting the liquid to flow out of the collecting container 20 via the outlet opening 58. The drain may be realized as a downpipe, in which the liquid may flow off purely due to gravitation. Principally it is also conceivable that the outflow device 56 comprises a suction device via which the liquid may be sucked out of the receiving volume 22 of the collecting container 20 actively.

Figure 4:
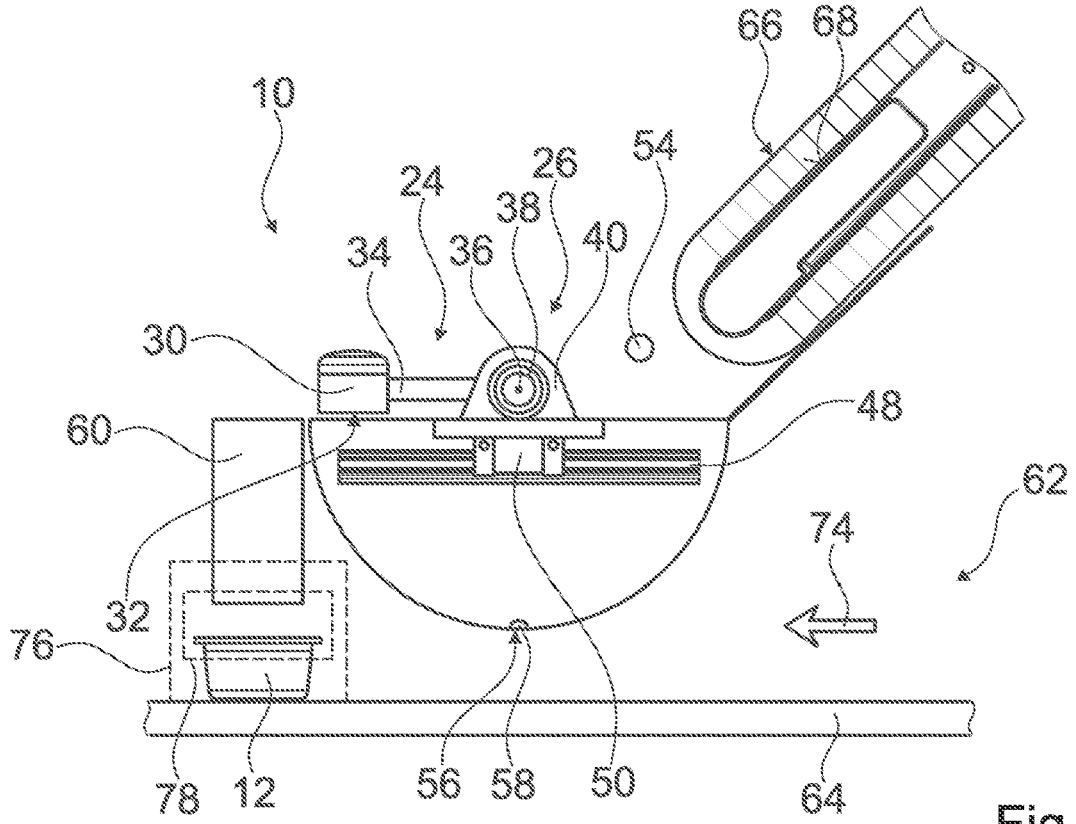
Figure 5:
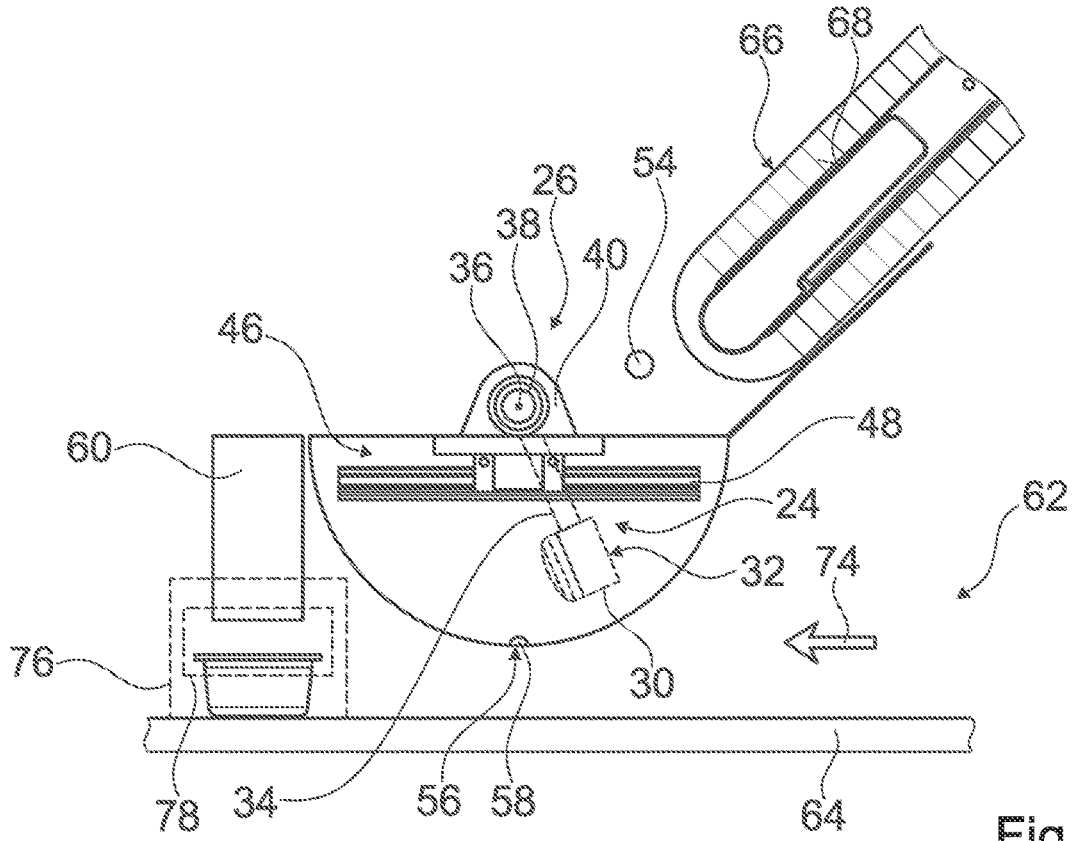
Figure 6:
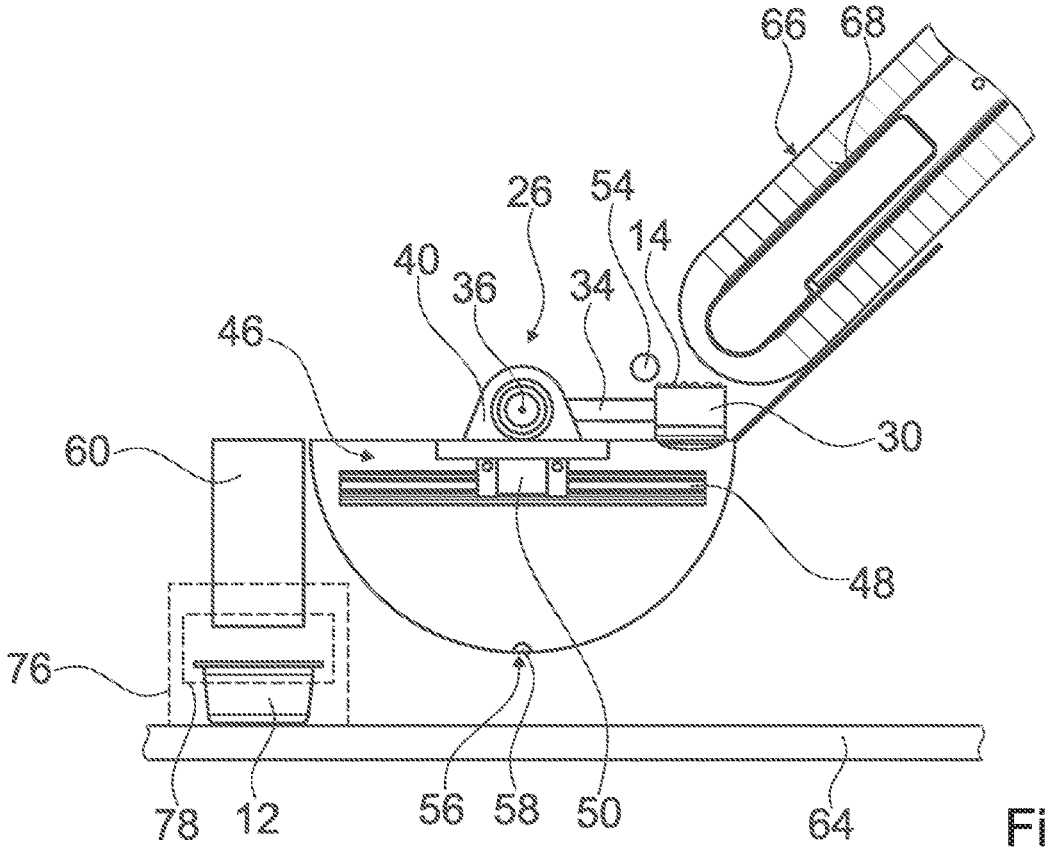
Figure 7:
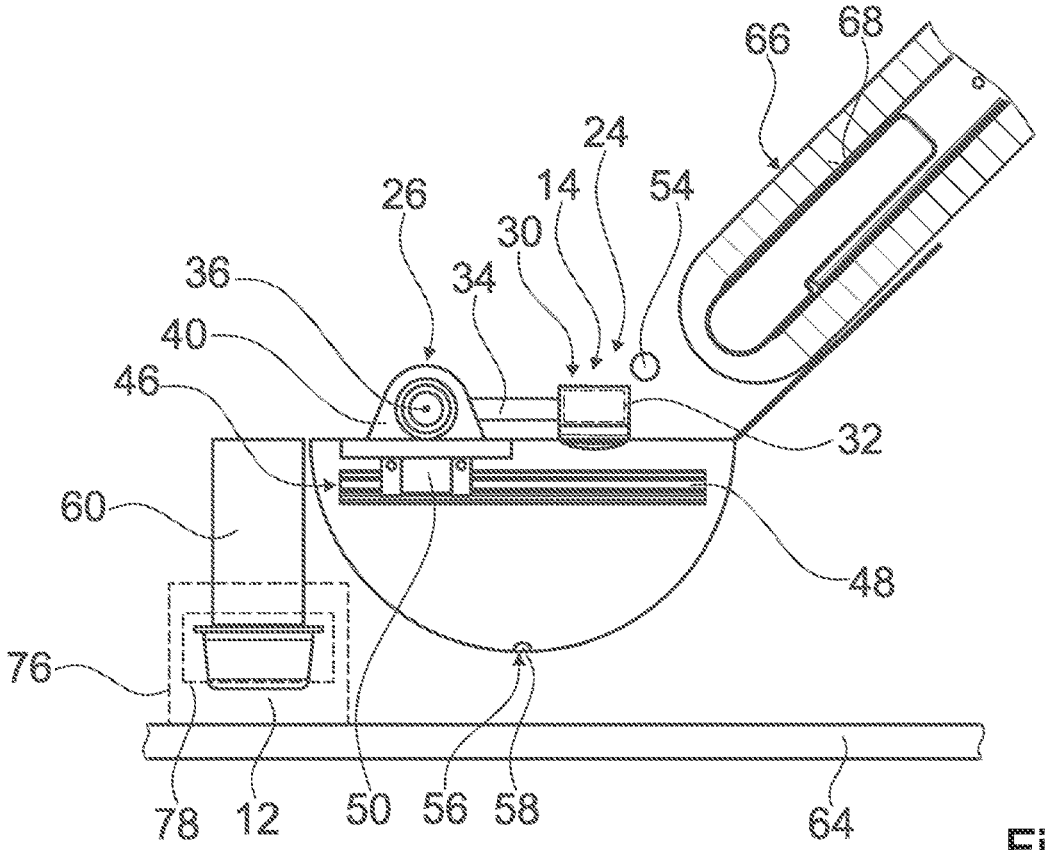

Via the linear bearings 46 of the support module 26, the metering element 24, 28 is axially displaceable between a removal position and a transfer position. In a removal position, which is shown in FIGS. 4 to 6, the metering element 24, 28 is oriented by means of the support module 26 such that it is pivotable with its metering region 30 through the receiving volume 22 of the collecting container 20 by a rotation around the rotation axis 36 of the bearing shaft 38. FIG. 4 shows the metering element 24, 28 in its removal position. In the removal position the metering element 24, 28 is placed such that it is pivotable through the receiving region 22 of the collecting container 20 by a 180-degree rotation around the rotation axis 36. In the removal position the metering element 24, 28 is not filled. The metering element 24, 28 is in its metering position oriented with an opening of its metering region 30 towards the receiving volume 22 of the collecting container 20.

For a removal of a metered volume of filling material 14 out of the collecting container 20, the metering element 24, 28 is pivoted through the receiving volume 22 of the collecting container 20 by a 180-degree rotation of the bearing shaft 38. The 180-degree rotation of the metering element 24, 28 is driven by an operation of the first drive unit 44. By the 180-degree rotation the metering element 24, 28 is moved out of its removal position, with its metering volume in a fore position, through the receiving volume 22 of the collecting container 20 and thus through the entire filling material 14 that is collected therein. In its metering region 30 the metering element 24, 28 takes in a corresponding volume of filling material 14. FIG. 5 shows exemplarily a position of the metering element 24, 28 during a pivoting around the rotation axis 36. After the 180-degree rotation, the metering element 24, 28 is arranged in its filling position. In the filling position the metering region 30 of the metering element 24, 28 is filled with filling material 14. The filling material 14 herein preferably protrudes beyond the metering volume 32 of the metering region 30. The metering element 24 is over-filled. In the filling position the metering element 24, 28 faces with the opening of its metering region 30 away from the collecting container 20.

If the metering element 24, 28 is arranged in its filling position, the metering element 24, 28 is linearly displaced from the removal position into a transfer position by means of the linear bearings 46 of the support module 26. The metering element 24, 28 is herein traversed past the wipe-off element 54. The wipe-off element 54 herein densifies the filling material 14 that is located in the metering region 30 of the metering element 24, 28 and wipes off filling material 14 that protrudes beyond the metering volume 32. The wiped-off filling material 14 drops back into the collecting container 20. Between the illustrations of FIG. 5 and FIG. 6, the metering element 24, 28 is traversed past the wipe-off element 54.

Figure 8:
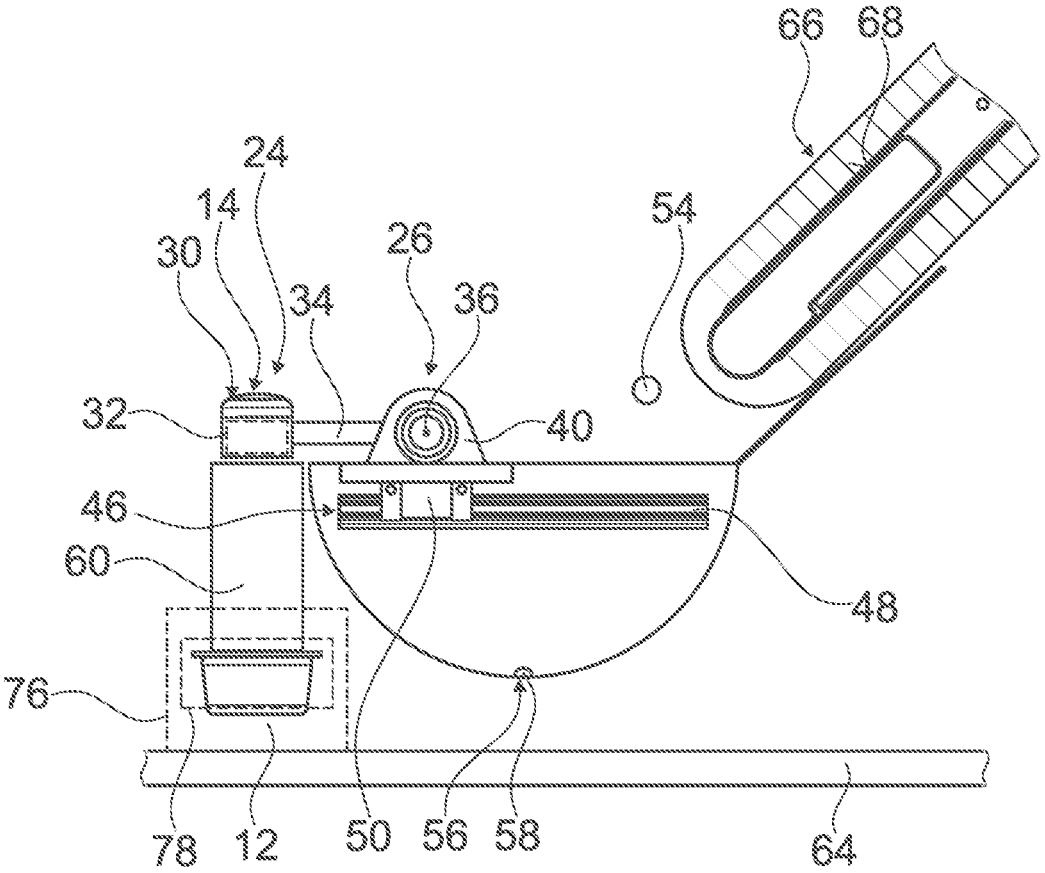

When the metering element 24, 28 has been wiped and is in its transfer position (FIG. 7), the metering element 24, 28 is pivoted into the transfer region, above the transfer element 60, by a 180-degree rotation of the bearing shaft 38. By the 180-degree pivoting of the metering element 24, 28, the metering element 24, 28 is pivoted into its transfer position, which is shown in FIG. 8. In the transfer position the metering element 24, 28 is arranged with the opening of its metering region 30 directly above the transfer element 60. The metered filling material 14 located in the metering region 30 drops through the transfer element 60 into the receptacle 12 that is to be filled and is arranged below the transfer element 60. The 180-degree rotation of the metering element 24, 28 is driven by an operation of the first drive unit 44. After transfer of the filling material 14 from the metering element 24, 28 into the receptacle 12 that is to be filled via the transfer element 60, the metering element 24, 28 is empty and is brought back into its removal position for a following removal of filling material 14. For this purpose the metering element 24, 28 is displaced axially from the transfer position into the removal position by means of the linear bearings 46 of the support module 26.

The system comprises a conveying device 62. The conveying device 62 is configured for a transport of the receptacles 12 that are to be filled. The conveying device 62 The conveying device 62 comprises a conveyor belt 64. The conveyor belt 64 is configured to transport the receptacles 12 that are to be filled in a transport direction 74. The conveyor belt 64 is implemented having a width that allows a side-by-side arrangement of the receptacles 12 which are to be filled simultaneously.

The second filling module 18 is implemented identically to the first filling module 16. The second filling module 18 is preferably implemented mirror-symmetrically to the first filling module 16. The second filling module 18 also comprises a collecting container 20' as well as metering elements 24', 28', which are movably supported via a support module 26', and transfer elements 60'. The second filling module 18 will therefore not be described in detail. The filling device 10 comprises a filling material feed 66. The filling material feed 66 is configured for a feeding of the filling material 14 into the collecting containers 20, 20' of the filling device 10. The filling material feed 66 is arranged between the filling modules 16, 18. The filling material feed 66 comprises two chutes 68, 68', via which the filling material 14 can slide into the collecting containers 20, 20'. The system comprises a conveyor belt 70, via which the filling material 14 of the filling material feed 66 is fed to the filling device 10.

The first filling module 16 of the filling device 10 comprises one lifting module 76 per each receptacle 12 that is to be filled. The lifting modules 76 are respectively configured to lift the corresponding receptacle 12 that is to be filled, for a filling with the filling material 14, from the conveyor belt 64 of the conveying device 62. The lifting modules 76 are in particular configured, for a filling with the filling material 14, to lift the receptacles 12 that are to be filled to the filling material exit of the respective transfer element 60. The lifting modules 76 each comprise a weight measuring module 78, which is configured to measure the weight of the receptacle 12 that is filled with the filling material 14. The weight measuring module 78 comprises, for example, a weighing cell, by means of which the weight of the filled receptacle 12 can be measured. By this arrangement of the weight measuring module 78 the weighing cells are advantageously arrangeable in a dry region of the filling device 10 for a measuring of the weight of the receptacles 12.

The filling device 10 comprises a control and regulation unit 80. The control and regulation unit 80 is configured for a controlling of the filling device 10. The control and regulation unit 80 actuates the respective drive units 44, 52 of the support module 26 to move the metering elements 24, 28 according to a method as described herein. The control and regulation unit 80 is also configured to control the lifting modules 76. The control and regulation unit 80 is furthermore configured to control the weight measuring modules 78 of the lifting modules 76 and to store measured weights of the receptacles 12 which are filled with the filling material 14.

The filling device 10 comprises a liquid-metering module 72. Viewed in the transport direction 74 of the conveying device 62, the liquid-metering module 72 is arranged downstream of the filling modules 16, 18 of the filling device 10. The liquid-metering module 72 comprises per each receptacle 12 that is to be filled a spray nozzle, via which the liquid can be discharged into the receptacle 12. The liquid-metering module 72 is configured to fill the receptacles 12 that are to be filled, depending on the weight measured by the weight measuring modules 78, with an adapted quantity of liquid in order to precisely obtain a required total weight of the receptacle 12 from the filling material 14 and the liquid. The control and regulation unit 80 is configured for a controlling of the liquid-metering module 72. On the basis of the filling weight measured by the corresponding weight measuring module 78, the control and regulation unit 80 calculates for each receptacle 12 that is to be filled a required quantity of liquid which is necessary to obtain a desired total filling weight of the filling material 14 located in the receptacle 12. The control and regulation unit 80 actuates the liquid-metering module 72 in such a way that each receptacle 12 is filled with the required quantity of liquid.

The invention claimed is:

1. A filling device for a metering of a given weight and/or volume of a filling material (14) that is to be metered, with a collecting container (20) which is configured for the filling material (14) that is to be metered to be collected therein, with a metering element (24, 28) which is configured, for a metering of the filling material (14), to remove a defined volume of the filling material (14) out of the collecting container (20), and with a support module (26) movably supporting the metering element (24, 28), wherein the support module (26) forms a rotation axis (36) and is configured to rotate the metering element (24, 28) around the rotation axis (36) for the purpose of removing the defined volume of the filling material (14) out of the collecting container (20), and wherein the support module (26) comprises at least one linear bearing (46), by which the metering element (24, 28) is adjustable between a removal position and a transfer position.

2. The filling device according to claim 1, wherein for a removal of the defined volume of the filling material out of the collecting container, the metering element (24, 28) is configured to be moved through a receiving volume (22) of the collecting container (20) by the support module (26).

3. The filling device according to claim 1, wherein the support module (26) is configured to rotate the metering element around the rotation axis (36) for a transfer of the removed filling material (14) to a receptacle (12) that is to be filled.

4. The filling device according to claim 1, further comprising a wipe-off element (54), which is configured, prior to a transfer of the filling material (14), to reduce the filling material (14) located in the metering element (24, 28) to the given volume.

5. The filling device according to claim 4, wherein the support module (26) is configured, in an adjustment from the removal position to the transfer position, to guide the metering element (24, 28) past the wipe-off element (54) in order to wipe off and/or densify the filling material (14) that is located in the metering element (24, 28).

6. The filling device according to claim 1, further comprising at least one transfer element (60), via which, in a transfer position of the metering element (24, 28), the filling material (14) that is to be metered can be conveyed from the metering element (24, 28) directly to a receptacle (12) that is to be filled.

7. The filling device according to claim 1, wherein the collecting container (20) is implemented as a tub, whose inner contour has an even curvature at least in a subregion.

8. The filling device according to claim 1, further comprising an outflow device (56), which is configured to transport away a liquid out of the collecting container (20), wherein an outlet opening (58) is arranged below a minimum ladling level of the metering element (24, 28).

9. The filling device according to claim 1, further comprising at least one further metering element (28), which is supported movably parallel to the one metering element (24) via the support module (26) and is configured, for a metering of the filling material (14), to remove a defined volume of the filling material (14) out of the collecting container (20).

10. The filling device according to claim 1, further comprising at least one liquid-metering module (72) which is configured, after a filling of a receptacle (12) that is to be filled with a filling material (14) by the metering element (24, 28), to fill the receptacle (12) with a liquid until a desired total filling volume and/or total filling weight has been reached.

11. A system with at least one filling device according to claim 1 for a filling of receptacles (12) that are to be filled with a given weight and/or volume of a filling material that is to be metered.

12. A method for a metering of a filling material by a filling device according to claim 1, wherein the support module (26) rotates the metering element (24, 28) around the rotation axis (36) for removing the defined volume of the filling material (14) out of the collecting container (20), and wherein the metering element (24, 28) is adjusted between the removal position and the transfer position by the linear bearing (46) of the support module (26).

13. The filling device according to claim 1, wherein the metering element is implemented as a metering ladle.

* * * * *